US006913143B2

(12) United States Patent
Yang

(10) Patent No.: US 6,913,143 B2
(45) Date of Patent: Jul. 5, 2005

(54) PEN COLLECTOR STRUCTURE WITH A POSITION-ADJUSTABLE COVER

(76) Inventor: Mei-Shun Lin Yang, No. 143, Ho Shan Street, Tainan (TW)

( * ) Notice: Subject to any disclaimer, the term of this patent is extended or adjusted under 35 U.S.C. 154(b) by 149 days.

(21) Appl. No.: 10/373,750

(22) Filed: Feb. 27, 2003

(65) Prior Publication Data

US 2004/0168940 A1 Sep. 2, 2004

(51) Int. Cl.[7] ..... B65D 85/28; B65D 43/16

(52) U.S. Cl. ..... 206/371; 206/443; 220/832; 220/844

(58) Field of Search ..... 206/371, 214, 206/224, 443; 211/69, 69.1; 220/830, 843–844, 848, 831–832

(56) References Cited

U.S. PATENT DOCUMENTS 5,125,508 A * 6/1992 Yamamoto ..... 206/714
5,234,108 A * 8/1993 Jorgensen ..... 206/575
5,248,030 A * 9/1993 Tarozzi ..... 206/1.7
5,992,426 A * 11/1999 Yuhara ..... 132/293
6,019,223 A * 2/2000 Harftst ..... 206/523
6,681,933 B1 * 1/2004 Demsien et al. ..... 206/371

* cited by examiner

*Primary Examiner*—Bryon P. Gehman
(74) *Attorney, Agent, or Firm*—Rosenberg, Klein & Lee

(57) ABSTRACT

A pen collector structure includes a case body and a pair of position-adjusting controllers provided in the pivot ears at the back of the case body and the upper cover. The case body is provided with several rows of small containers in the interior. The small containers are disposed at an oblique angle. Each pivot ear of the case body has a screw hole for an inserting rod. A though hole is provided nearby each screw hole to receive a bead and an elastic element. In each pivot ear of the upper cover is provided with a through hole for each inserting rod to be inserted in, and a groove is provided at the outer end to receive a cushion. A small hole is provided in each cushion to be penetrated by each inserting rod, and several recesses are provided in the side of each cushion.

4 Claims, 7 Drawing Sheets

PEN COLLECTOR STRUCTURE WITH A POSITION-ADJUSTABLE COVER

BACKGROUND OF THE INVENTION

1. Field of the Invention

The present invention relates to a pen collector structure with a position-adjustable cover, and more particularly to a pen collector structure which is provided with small containers being disposed at a predetermined oblique angle in the case body so as to make the best space utility of the case body to receive more pens.

2. Description of the Related Art

Various kinds of pens are necessary in daily life because they are frequently used by students and ordinary people. Especially, crayons are indispensable for kindergarteners and primary school pupils.

Referring to FIG. 1, a conventional pen collector 30 is provided with a case body 301, and several rows of level small containers 302 are disposed in the case body 301. The small containers 302 are provided to receive pens 40, as shown in FIG. 2, so as for the pens 40 to be conveniently carried.

However, there are drawbacks in the above-mentioned conventional pen collector.

1. Because the small containers in the case body are disposed at a same level, the space utility of the case body is limited so that the conventional pen collector with a predetermined dimension can only receive a certain quantity of pens.
2. When the pens are placed in the level small containers, it is not convenient for a user to take out a pen from a small container because there is little space between two pens, referring to FIG. 3.
3. Because the conventional pen collector with a predetermined dimension can only receive a certain quantity of pens, a user should buy another bulky pen collector in order to receive more pens. It not only costs much but also occupies bulky space of a desk so as to cause trouble to the user.
4. When the conventional pen collector on a desk is open, the cover will occupy the space of a desk because it is not provided with any supporting device.

SUMMARY OF THE INVENTION

Accordingly, the present invention is directed to a pen collector structure with a position-adjustable cover that can substantially obviate the drawbacks of a conventional related pen collector and promote the practical use.

An object of the present invention is to provide a pen collector structure which can make the best space utility of the case body with a predetermined dimension so as to receive more pens.

Another object of the present invention is to provide a pen collector structure which can provide with more rows of small containers in the case body because the rows of small containers are disposed at a predetermined oblique angle.

Yet another object of the present invention is to provide a pen collector structure whose small containers are disposed at a predetermined oblique angle to hold pens, and that the pen tails in every front row of small containers extend outward and keep a proper separation away from the pen heads in every rear row of small containers so as to be convenient for a user to fetch.

It is a further object of the present invention to provide a pen collector structure which is provided with a position-adjustable cover which can stand up so as not to occupy space when the cover is open.

To achieve these advantages, a pen collector structure with a position-adjustable cover in the present invention includes a case body and a pair of position-adjusting controllers respectively provided in the pivot ears at the back of the case body. The case body is provided with several rows of small containers in the interior. Each row of small containers is disposed at a predetermined oblique angle. Both the head end and the tail end of each small container are provided with flanges so as to hold a pen. Each pivot ear has a screw hole to be penetrated by an inserting rod. Nearby each screw hole is provided with a though hole to receive a bead and an elastic element. At the outer end of each pivot ear is provided with a room to receive a tapping block. In each pivot ear at the back of the upper cover is provided with a through hole for the inserting rod to be inserted in, and a groove is provided at the outer end to receive a cushion. A small hole is provided in the cushion to be penetrated by the inserting rod. There are some recesses provided in the side of the cushion.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 2:
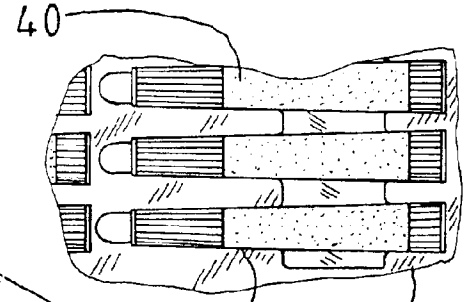
FIG. 2 (PRIOR ART)
FIG. 2 is a partial schematic view showing the condition pens being held in the small containers of the conventional pen collector.
Figure 3:
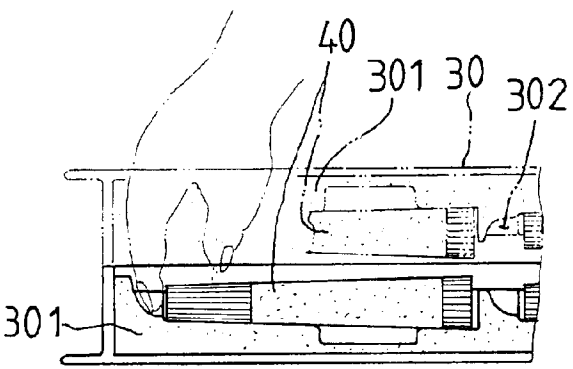
FIG. 3 (PRIOR ART)
FIG. 3 is a schematic view showing a user taking a pen out of a small container of the conventional pen collector.
Figure 1:
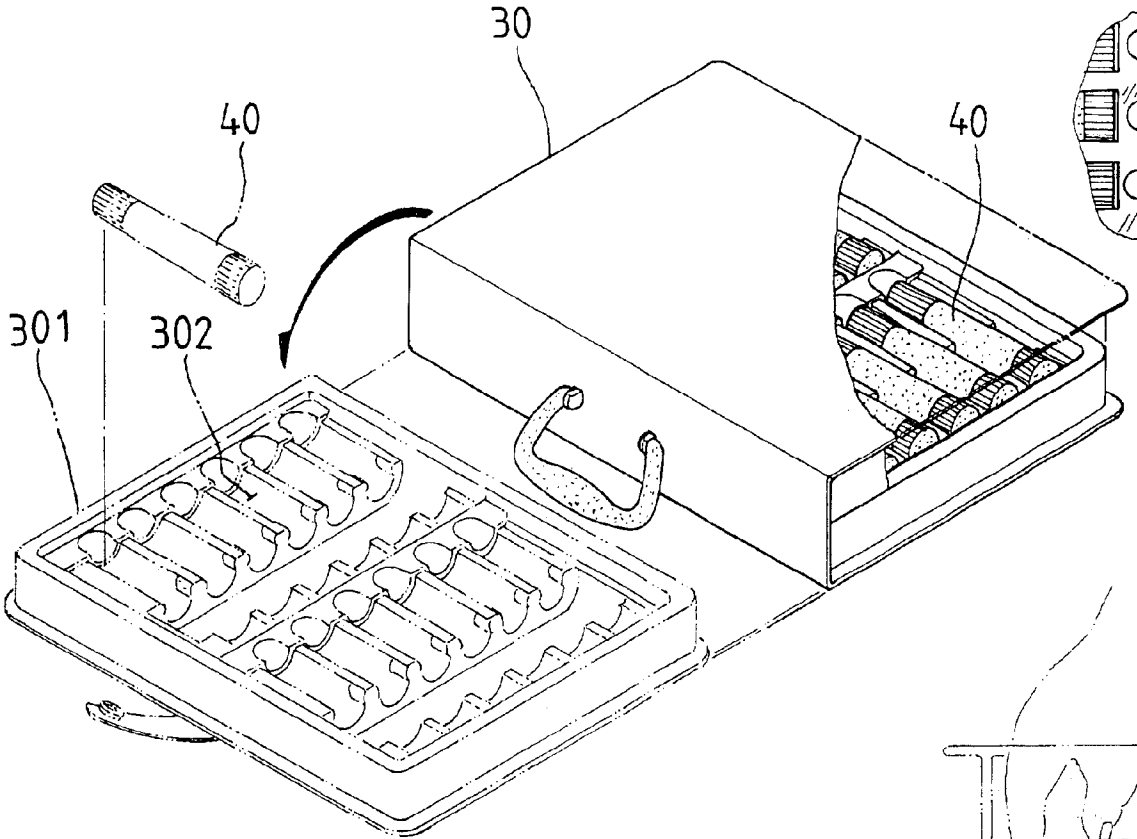
FIG. 1 (PRIOR ART)
FIG. 1 is a perspective schematic view of a conventional pen collector in spread and closed conditions.
Figure 4:
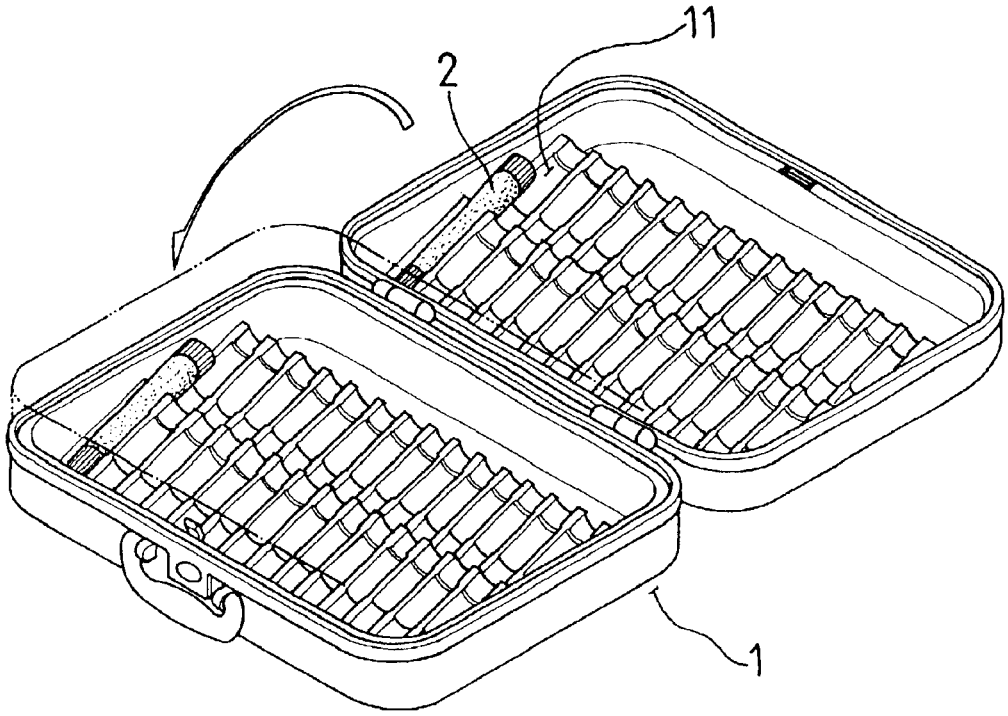
FIG. 4 is a perspective spread view of an embodiment of a pen collector structure in accordance with the present invention.
Figure 5:
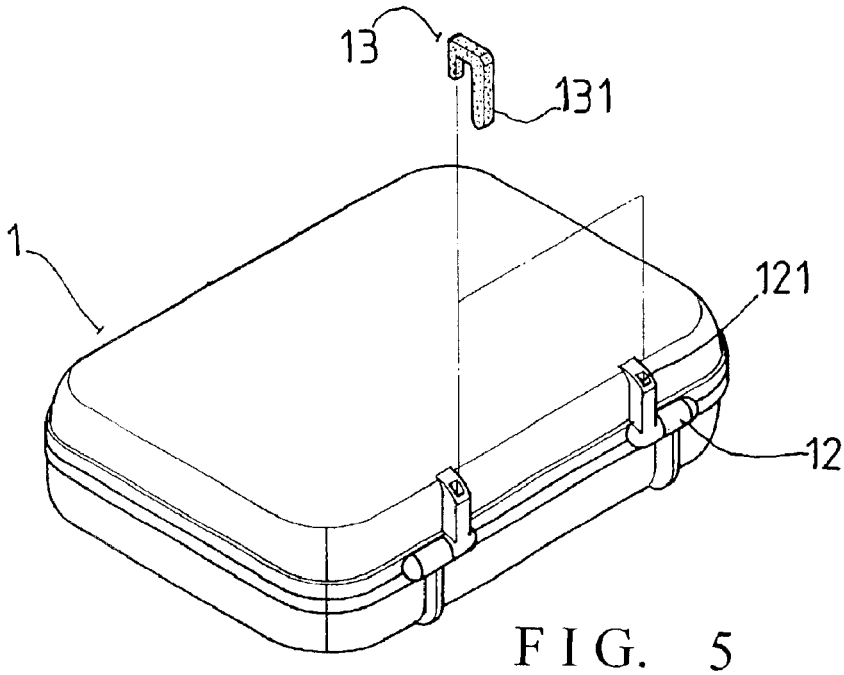
FIG. 5 is a perspective exploded view of the pen collector and the supporting seat in accordance with the present invention.

Referring to FIGS. 4 and 5, a preferred embodiment of a pen collector structure with a position-adjustable cover includes a case body 1 and a pair of position-adjusting controllers respectively provided in the pivot ears 12 at the back of the case body 1.

The case body 1 is provided with several rows of small containers 11 in the interior. Each row of small containers 11 is disposed at a predetermined oblique angle (preferentially 15°). Both the head end and the tail end of each small container 11 are provided with flanges so as to hold a pen 2. An inserting hollow 121 is provided above the top of each pivot ear 12 at the back of the case body 1, so as for a supporting seat 13 to be inserted in.

Figure 6:
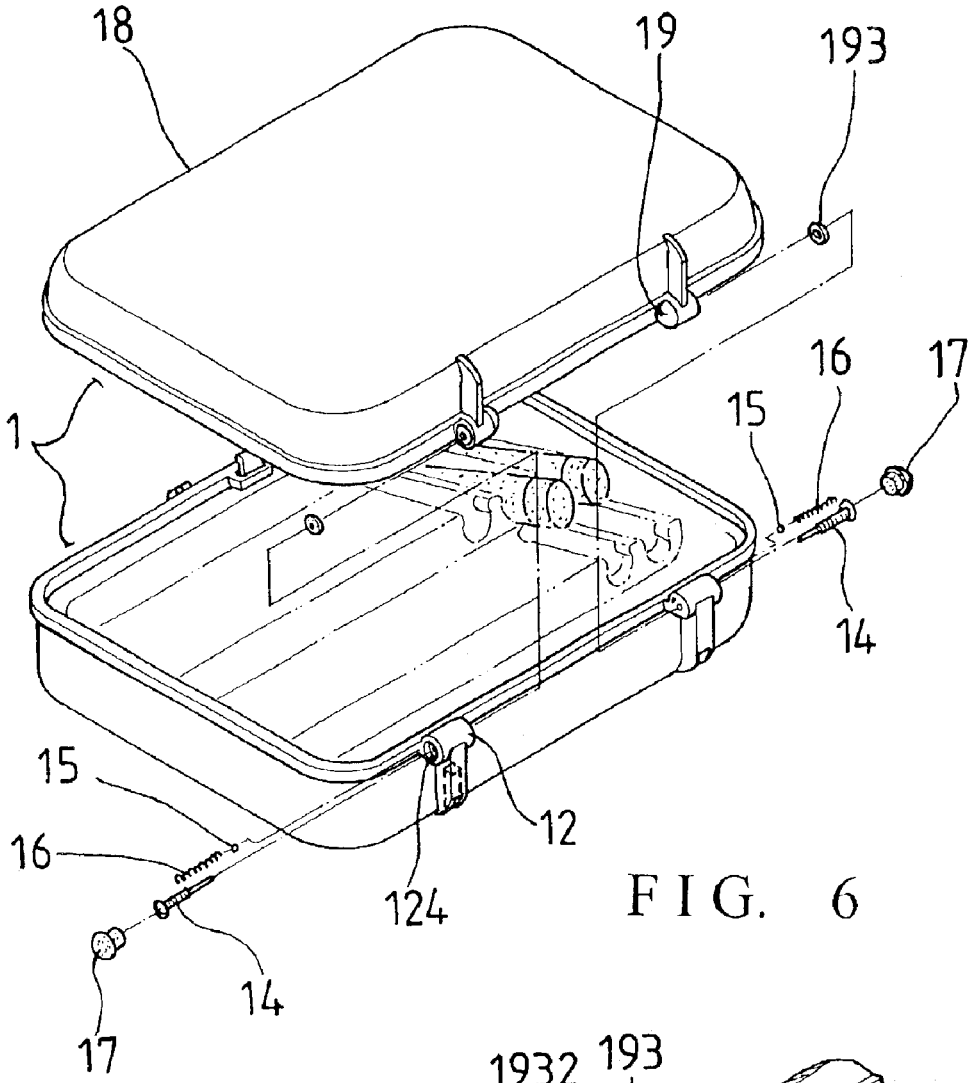
FIG. 6 is a perspective exploded view of the pen collector and the position-adjusting controllers in accordance with the present invention.
Figure 7:
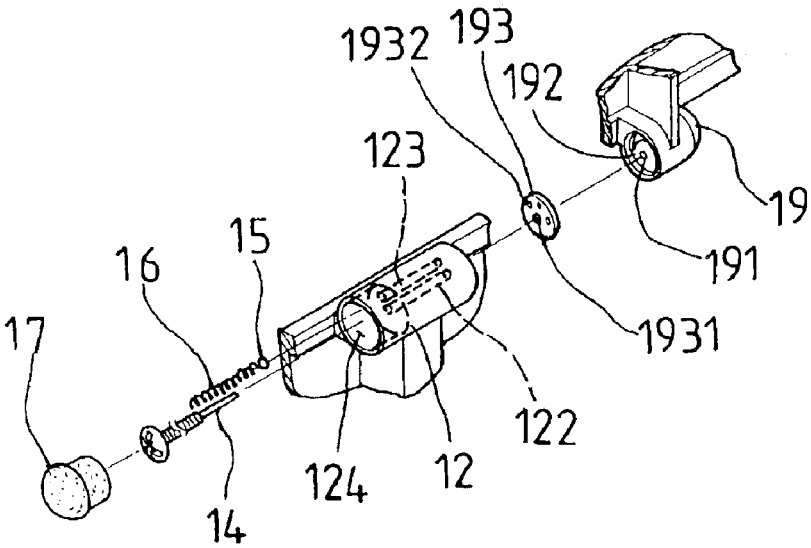
FIG. 7 is a perspective exploded view of the position-adjusting controllers in accordance with the present invention.

Referring to FIGS. 6 and 7, each position-adjusting controller is provided in each pivot ear 12 at the back end of the case body 1. Each pivot ear 12 has a screw hole 122 to be penetrated by an inserting rod 14. Nearby each screw hole 122 is provided with a though hole 123 to receive a bead 15 and an elastic element 16. At the outer end of each pivot ear 12 is provided with a room 124 to receive a tapping block 17. In each pivot ear 19 at the back of the upper cover 18, a through hole 191 is provided for the inserting rod 14 to be inserted in. At the outer end of each pivot ear 19 of the upper cover 18, a groove 192 is provided to receive a cushion 193. A small hole 1931 is provided in each cushion 193 to be penetrated by each inserting rod 14. A plurality of recesses 1932 are provided in the side of each cushion 193.

Figure 8:
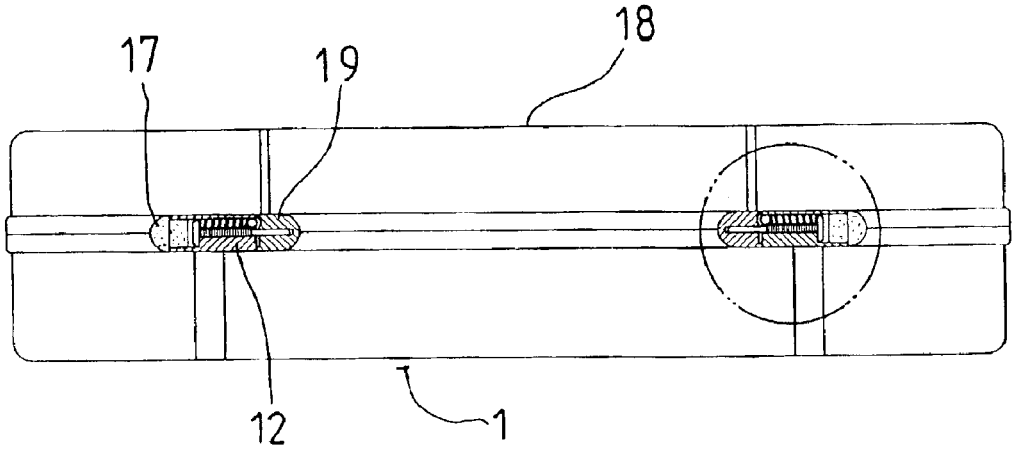
FIG. 8 is a rear sectional view of the pen collector being provided with position-adjusting controllers in assembled configuration in accordance with the present invention.
Figure 9:
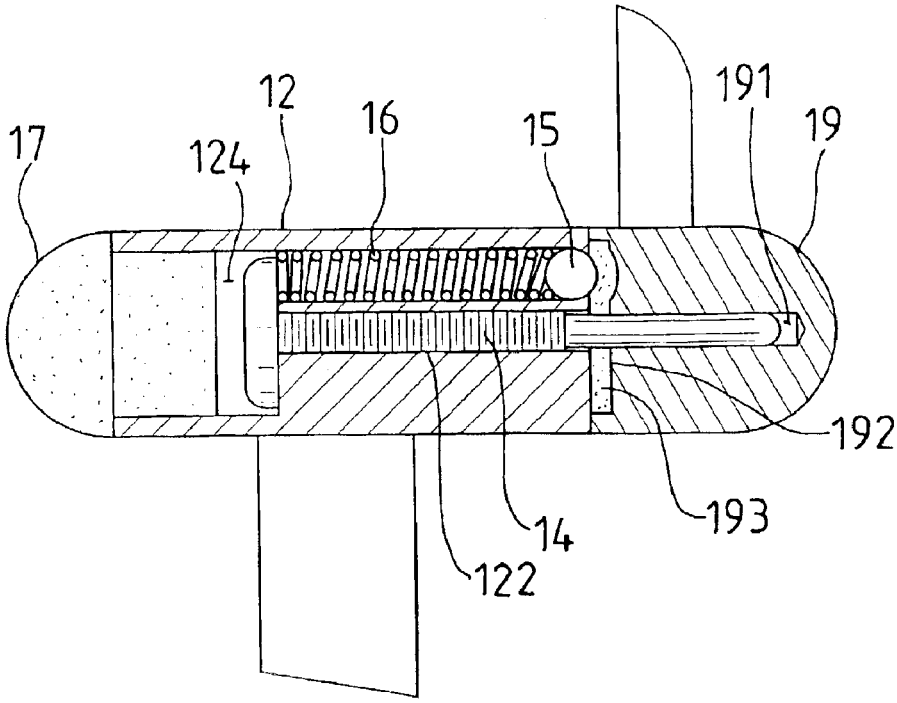
FIG. 9 is a sectional view of the position-adjusting controller in assembled configuration in accordance with the present invention.

Looking at the pen collector structure being used, and referring to FIGS. 7, 8 and 9, firstly each cushion 193 is inserted into each groove 192 of the upper cover 18, and the two pivot ears 19 of the upper cover 18 are respectively aligned to the two pivot ears 12 of the case body 1. Secondly, each bead 15 and each elastic element 15 in each through hole 123 so as to make the outer edge of each bead 15 reach a recess 1932 of the cushion 193. Thirdly, the screw part of each inserting rod 14 is inserted into each screw hole 122 and penetrated through each small hole 1931 of each cushion 193 to reach each through hole 191 of the upper cover 18 so as for each position-adjusting controller to be firmly assembled. Finally, each tapping block 17 is inlaid in each room 124.

Figure 10:
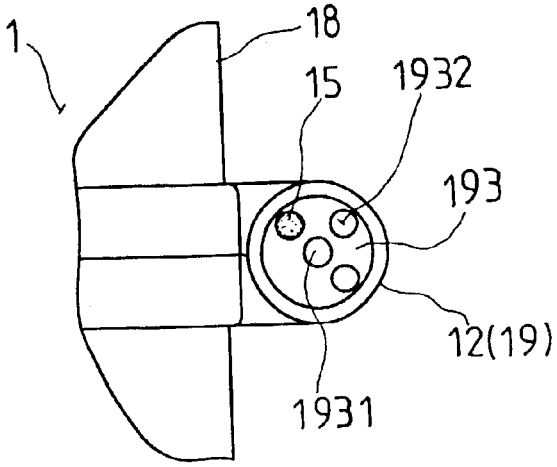
FIG. 10 is a schematic view of the position-adjusting controller structure being operated in accordance with the present invention.
Figure 11:
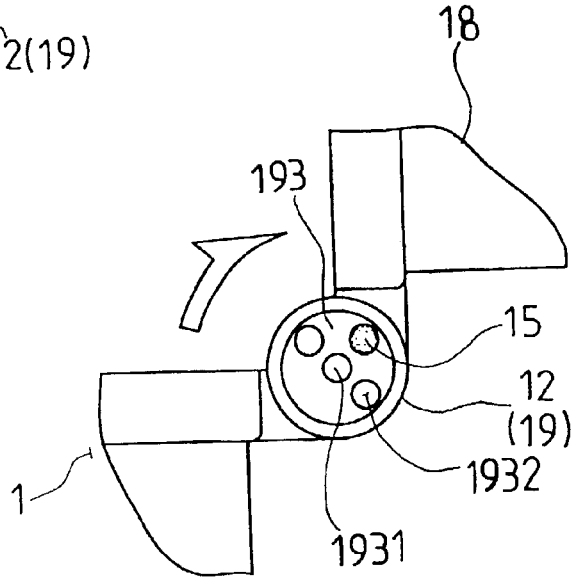
FIG. 11 is another schematic view of the position-adjusting controller being operated in accordance with the present invention.
Figure 12:
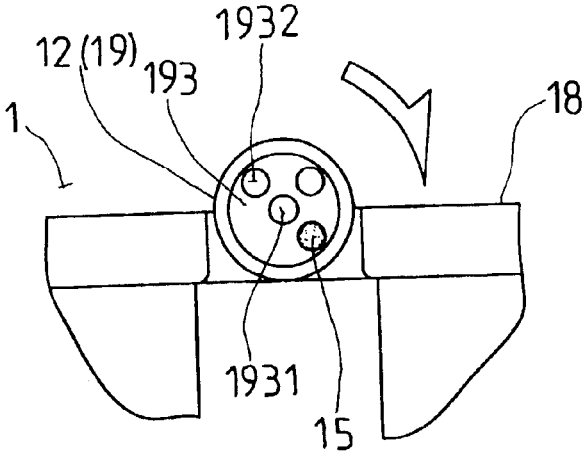
FIG. 12 is one more schematic view of the position-adjusting controller being operated in accordance with the present invention.

Referring to FIGS. 10, 11 and 12, when the upper cover 18 is opened, each inserting rod 14 and each cushion 193 are driven to turn, and each bead 15 will be rolling. When the upper cover 18 is opened at a predetermined angle, the outer edge of each bead 15 will be inlaid in a certain recess 1932 of each cushion 193.

Figure 13:
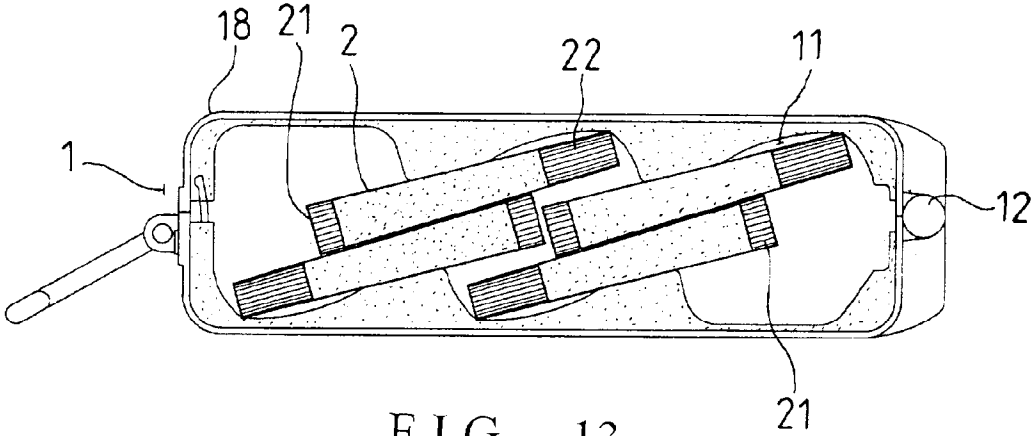
FIG. 13 is a side sectional view of the pen collector in closed condition and pens being placed in the small containers in accordance with the present invention.
Figure 14:
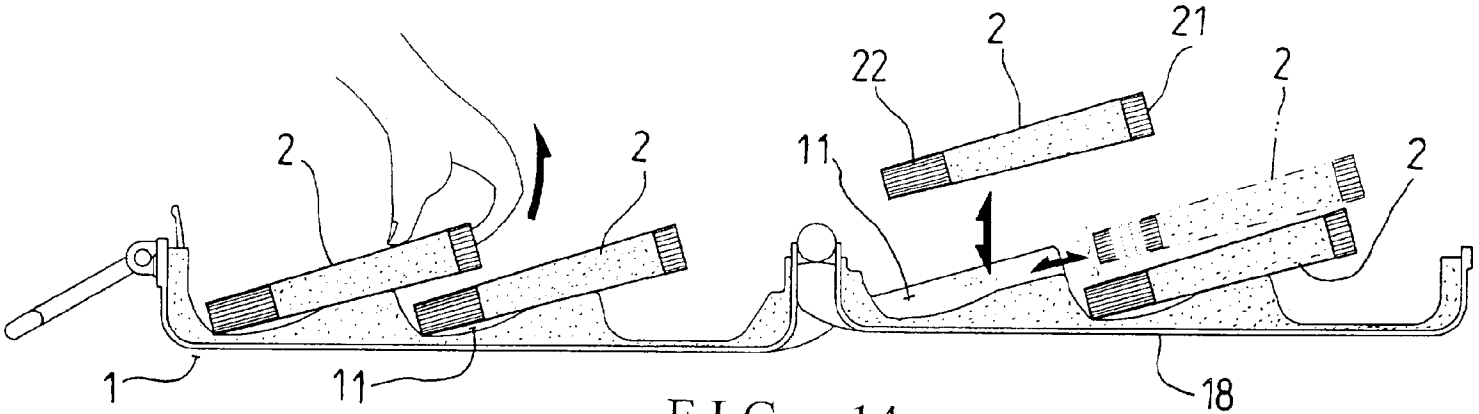
FIG. 14 is a schematic view showing a pen being taken out of a small container in the pen collector in accordance with the present invention.

When the pen 2 is placed in a small container 11, the flanges at the head end and the tail end of the small container 11 will hold the pen 2 fast. The small containers 11 are disposed at a predetermined oblique angle, so the tail 21 of the pen 2 extends out of the small container 11 and keeps a proper separation away from the head 22 of the next pen 2, convenient for the user to fetch. When the case body 1 is covered, the pens 2 in the upper cover 18 abut upon the pens 2 in the case body 1 in an opposite direction, so as to make the best utility of the inner space, as shown in FIGS. 13 and 14.

Figure 15:
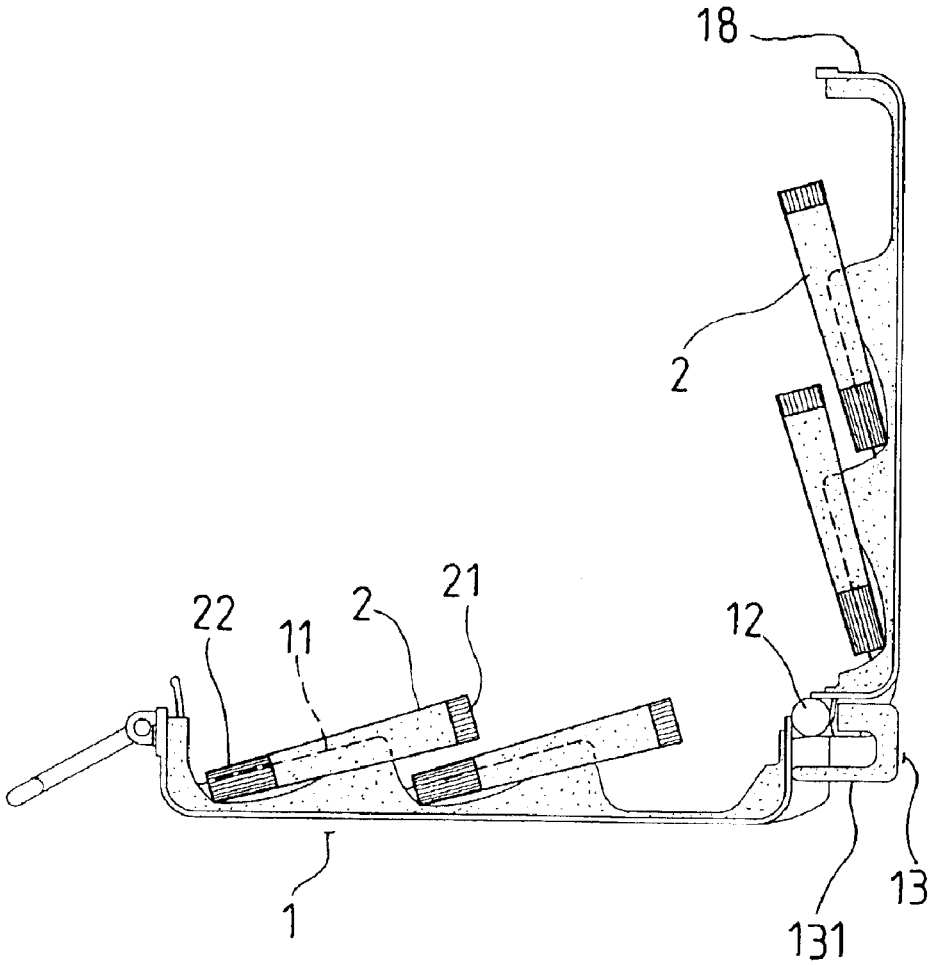
FIG. 15 is a schematic view showing the supporting seat being utilized to support the cover of the pen collector in accordance with the present invention; and, FIG. 16 is another schematic view showing the supporting seat being utilized to support the cover of the pen collector in accordance with the present invention.
Figure 16:
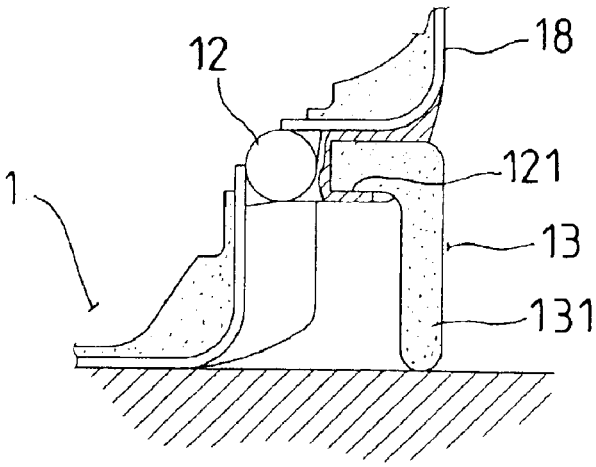

When the case body 1 is open (at about 90°), the supporting rod 131 of the supporting seat 13 can be placed at a certain position of the case body 1 to support the cover 18, so as to prevent the cover 18 from falling backward, as shown in FIG. 15. Otherwise, as shown in another implementation example in FIG. 16, the supporting rod 131 stands directly on the ground to support the upper cover 18.

While the preferred embodiments of the invention have been described above, it will be recognized and understood that various modifications may be made thereto, and the appended claims are intended to cover all such modifications which may fall within the spirit and scope of the invention.

What is claimed is:

1. A pen collector structure with a position-adjustable cover comprising:

a case body being provided with a plurality of rows of first small containers in an interior space thereof, each said row of first small containers being disposed at a predetermined oblique angle with respect to the case body, opposing end portions of each of said first small containers having flanges formed thereon for releasably holding a pen, a pair of first pivot ears being provided at a back end of said case body, each of said first pivot ears having a pivot rod extending therethrough and a spring biased ball extending from a through hole formed in each respective said first pivot ear;

an upper cover being hingedly coupled to said case body and having a plurality of rows of second small containers disposed in an interior space thereof, each said row of second small containers being disposed at said predetermined oblique angle, opposing end portions of each of said second small containers having flanges formed thereon for releasable holding a pen, a pair of second pivot ears being provided at a back end of said upper cover and disposed adjacent a respective one of said first pivot ears, each of said second pivot ears having a groove formed adjacent one end thereof and a through opening for receiving said pivot rod therein to provide rotational displacement of said second pivot ears relative to said first pivot ears; and, a pair of cushions respectively disposed in said grooves of said second pivot ears for rotation therewith, each of said cushions having a small hole formed therein for passage of said pivot rod therethrough and a plurality of recesses formed in angularly spaced relationship and alignable with said spring biased ball to form a detent therewith for maintaining predetermined angular positions of said upper cover relative to said case body.

2. A pen collector structure with a position-adjustable cover, as recited in claim 1, further comprising a pair of supporting seats, said upper cover having an inserting hollow formed above each of said second pivot ears for respectively removably receiving said pair of supporting seats therein to limit rotation of the upper cover relative to said case body and hold said upper cover in an upright position.

3. A pen collector structure with a position-adjustable cover, as recited in claim 2, wherein each said supporting seat has a supporting rod extending therefrom, said supporting rod being rotatable displaced to contact said back end of said case body responsive to rotative displacement said upper cover to said upright position.

4. A pen collector structure with a position-adjustable cover, as recited in claim 2, wherein each said supporting seat has a supporting rod extending therefrom, said supporting rod being rotatably displaced to contact a base surface responsive to rotative displacement said upper cover to said upright position.

* * * * *